US008674848B2

(12) United States Patent
Eggleton et al.

(10) Patent No.: US 8,674,848 B2
(45) Date of Patent: Mar. 18, 2014

(54) QUEUE CONTROL SYSTEM

(75) Inventors: Richard Eggleton, Vantaa (FI); Göran Sundholm, Tuusula (FI)

(73) Assignee: ELSI Technologies Oy, Vantaa (FI)

( * ) Notice: Subject to any disclaimer, the term of this patent is extended or adjusted under 35 U.S.C. 154(b) by 300 days.

(21) Appl. No.: 13/145,238

(22) PCT Filed: Jan. 19, 2010

(86) PCT No.: PCT/FI2010/050026

§ 371 (c)(1),
(2), (4) Date: Jul. 19, 2011

(87) PCT Pub. No.: WO2010/084248

PCT Pub. Date: Jul. 29, 2010

(65) Prior Publication Data

US 2011/0273312 A1 Nov. 10, 2011

(30) Foreign Application Priority Data

Jan. 20, 2009 (FI) ..... 20095043

(51) Int. Cl.
*G08G 1/095* (2006.01)

(52) U.S. Cl.
USPC ..... 340/944; 340/691.1; 340/5.2; 340/332; 340/815.4; 340/815.78

(58) Field of Classification Search
USPC ..... 340/944, 691.1, 4.3, 4.31, 5.2, 5.5, 6.1, 340/6.12, 331, 332, 815.4, 815.42, 815.45, 340/815.54, 815.78; 116/202, 240, 278
See application file for complete search history.

(56) References Cited

U.S. PATENT DOCUMENTS

| | | | | |
|---|---|---|---|---|
| 3,868,670 | A * | 2/1975 | O'Nory et al. | 340/286.06 |
| 3,921,160 | A | 11/1975 | Ratner | |
| 4,398,257 | A * | 8/1983 | Paganini et al. | 713/300 |
| 4,675,647 | A * | 6/1987 | Salin et al. | 340/286.06 |
| 4,700,295 | A * | 10/1987 | Katsof et al. | 705/7.13 |
| 5,245,163 | A * | 9/1993 | Bar-Yehuda | 235/377 |
| 5,815,068 | A * | 9/1998 | Vadseth | 340/332 |
| 7,801,629 | B2 * | 9/2010 | Hale et al. | 700/83 |
| 2004/0025780 | A1 | 2/2004 | Pharo et al. | |
| 2007/0048084 | A1 | 3/2007 | Jung et al. | |
| 2007/0050240 | A1 | 3/2007 | Belani et al. | |

FOREIGN PATENT DOCUMENTS

| | | | |
|---|---|---|---|
| DE | 10 2004 005 371 | A1 | 8/2004 |
| GB | 2 162 349 | A | 1/1986 |
| JP | 2002-173029 | A | 6/2002 |

(Continued)

*Primary Examiner* — Toan N Pham
(74) *Attorney, Agent, or Firm* — Birch, Stewart, Kolasch & Birch, LLP

(57) ABSTRACT

A queue control system for guiding persons waiting for service by a plurality of service desks, such as check-in desks at an airport, the system comprising computer control means for controlling the system, wherein system further comprises: stripe-like or band-like lighting means arranged for each desk (Desk 1-Desk 3) provided with point-like light sources, like LEDs, coupled to a circuit board, the circuit board being adapted to provide variable lighting operations, wherein each lighting means have at least a stripe-like or band-like part (101-103) arranged in the direction of the queue; and wherein the control computer means are adapted to variably control the lighting of the stripe-like or band-like lighting means in order to guide the persons in the queues and/or entering and/or leaving the queues.

19 Claims, 4 Drawing Sheets

(56) References Cited

FOREIGN PATENT DOCUMENTS

| | | | |
|---|---|---|---|
| JP | 2005-271765 | A | 10/2005 |
| WO | WO 98/23896 | A1 | 6/1998 |
| WO | WO 01/42739 | A1 | 6/2001 |
| WO | WO 2005/093678 | A1 | 10/2005 |
| WO | WO 2006/003245 | A1 | 1/2006 |
| WO | WO 2008/121036 | A1 | 10/2008 |

* cited by examiner

QUEUE CONTROL SYSTEM

TECHNICAL FIELD

The present invention relates to a queue control system. Especially the present invention relates to a queue control system for guiding persons waiting for service by a plurality of service points, such as check-in desks at an airport.

BACKGROUND OF THE INVENTION

Queue control systems may be used in many places for guiding persons waiting for service by a plurality of service points, such as check-in desks at an airport, tellers at banks, etc in order to guide persons' queuing.

Queue control systems may thus used for example in commercial banks servicing a large number of customers. The customers may nowadays for example form a single queue which is serviced by a plurality of tellers, and as each customer reaches the beginning of the queue the customer proceeds to the first available teller. In such a system, the queue length will increase with an increase in the rate of customers joining the queue or with a decrease in the number of tellers servicing the queue, and will decrease with a decrease in the number of customers joining the queue or with an increase in the number of tellers servicing the queue. If the queue becomes too long, this increases the waiting time of the customers and breeds dissatisfaction; but if the queue disappears altogether, this results in one or more tellers being idle and thereby a wastage of labor. Such queues may be controlled by visual observation and personal judgement. However, such a system is very inefficient since it is not only imprecise, resulting in lines becoming too long or completely eliminated, but is also time-consuming since it requires continuous observation by management personnel.

U.S. Pat. No. 5,245,163 discloses a queue monitoring and control system for monitoring and controlling a queue of persons waiting for service by a plurality of clerks, comprising: a card dispenser for dispensing sequentially-numbered cards to persons as each joins the end of the queue; a plurality of card readers, one for each clerk, for reading the card number when received by the clerk from each person as each reaches a clerk at the beginning of the queue; a real time clock for indicating the queue joining time for each card dispensed by the dispenser to a person when joining the end of the queue, and the clerk reaching time for each card read by the card readers as each person reaches a clerk at the beginning of the queue; and a data processor including: means for inputting predetermined fixed data relating to permissible queue parameters; means for inputting the card numbers and queue joining times from the card dispenser and the real time clock, and the card numbers and clerk reaching times from the card readers and the real time clock; and programmed means for controlling the data processor to indicate any changes in the number of clerks required in order to comply with the permissible queue parameters of the inputted fixed data.

Also this kind of prior art queue control systems have certain problems: they are complex and ineffective especially as they require a complex control apparatus with card dispensers and further a plurality of card readers, one for each clerk, for reading the card number when received by the clerk from each person etc.

SUMMARY OF THE INVENTION

The object of the present invention is to eliminate the above-mentioned drawbacks of the prior art queue control systems.

The present invention thus provides a new queue control system for guiding persons waiting for service by a plurality of service points.

The present invention is based on the idea to utilize longitudinal light stripes or bands that arranged in front of the service points to control queuing of the persons and guiding them to choose a right queue from the plurality of queues.

In order to implement this the system is provided with light stripes provided with a plurality of point-like light sources, such as LEDs (Light Emitting Diode) that can be operated in various lighting schemes in order to guide the persons in the queue, and also persons entering or leaving the queue.

The stripe can be located either on or in the floor, on the ceiling or wall mounted or in existing queuing post and tape type systems where the tape was replaced by the stripe.

In a preferred embodiment the light stripe is a LED stripe disclosed in WO 98/23896 which can be controlled in various ways, e.g. with a light moving along the queue or on/off, and which may be provided with LEDs with different colours, typically red and green in this kind of embodiment.

According to a further embodiment of the present invention each queue may be provided with a light stripe arrangement that consists of a longitudinal light stripe, typically the length of which is 5 to 10 m and also a much shorter cross light stripe, so called stop line, arranged at the beginning of the longitudinal stripe perpendicular to it in order to indicate whether that queue can be entered or not.

Characteristic features of the system according to the present invention are in detail presented in the enclosed claims.

The system of the present invention is very reliable, especially when LED stripes provided with a plurality of LEDs are used, effective and simple.

BRIEF DESCRIPTION OF THE DRAWINGS

In the following, the invention will be described in more detail with reference to the appended drawings, in which.

DETAILED DESCRIPTION OF THE INVENTION

Figure 1:
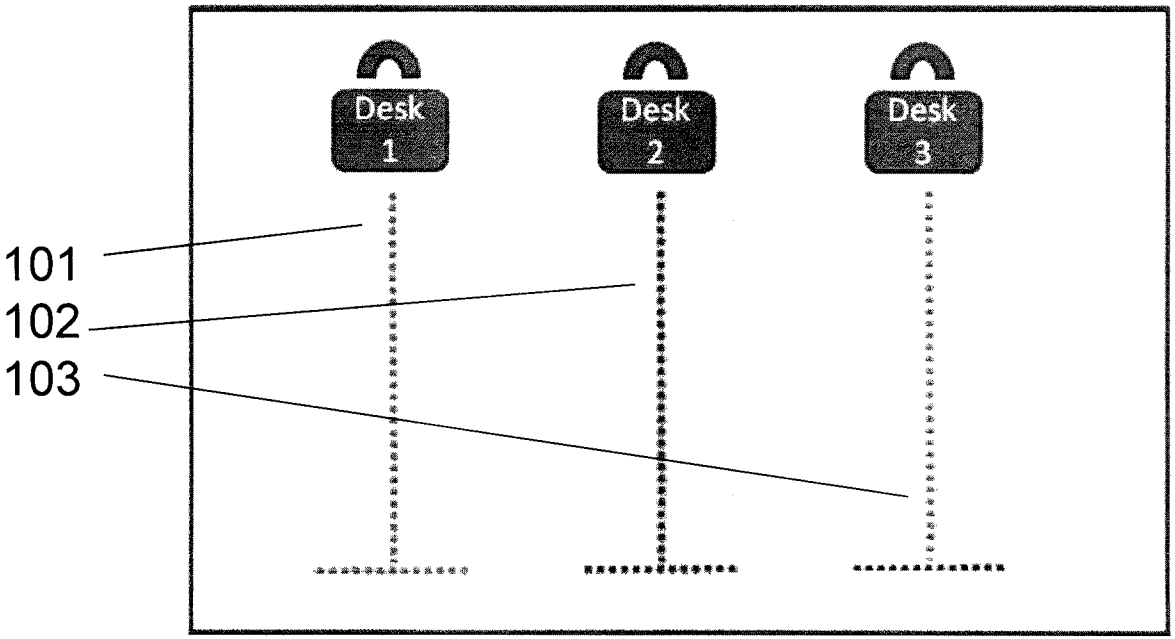
FIG. 1 presents a simplified view of one implementation of the present invention.
Figure 2:
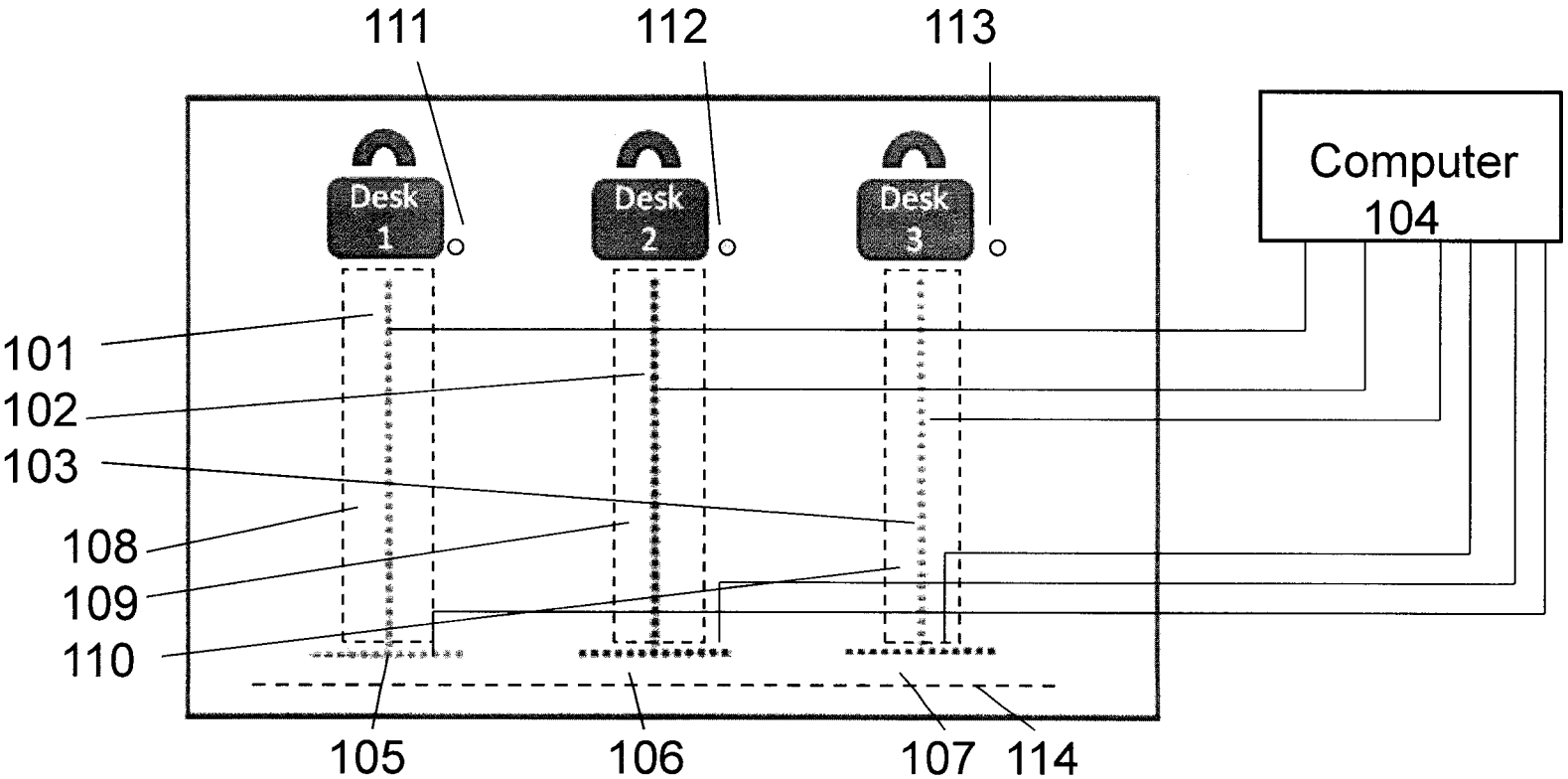
FIG. 2 presents a view of FIG. 1 added with a block diagram of the queue control system.
Figure 3:
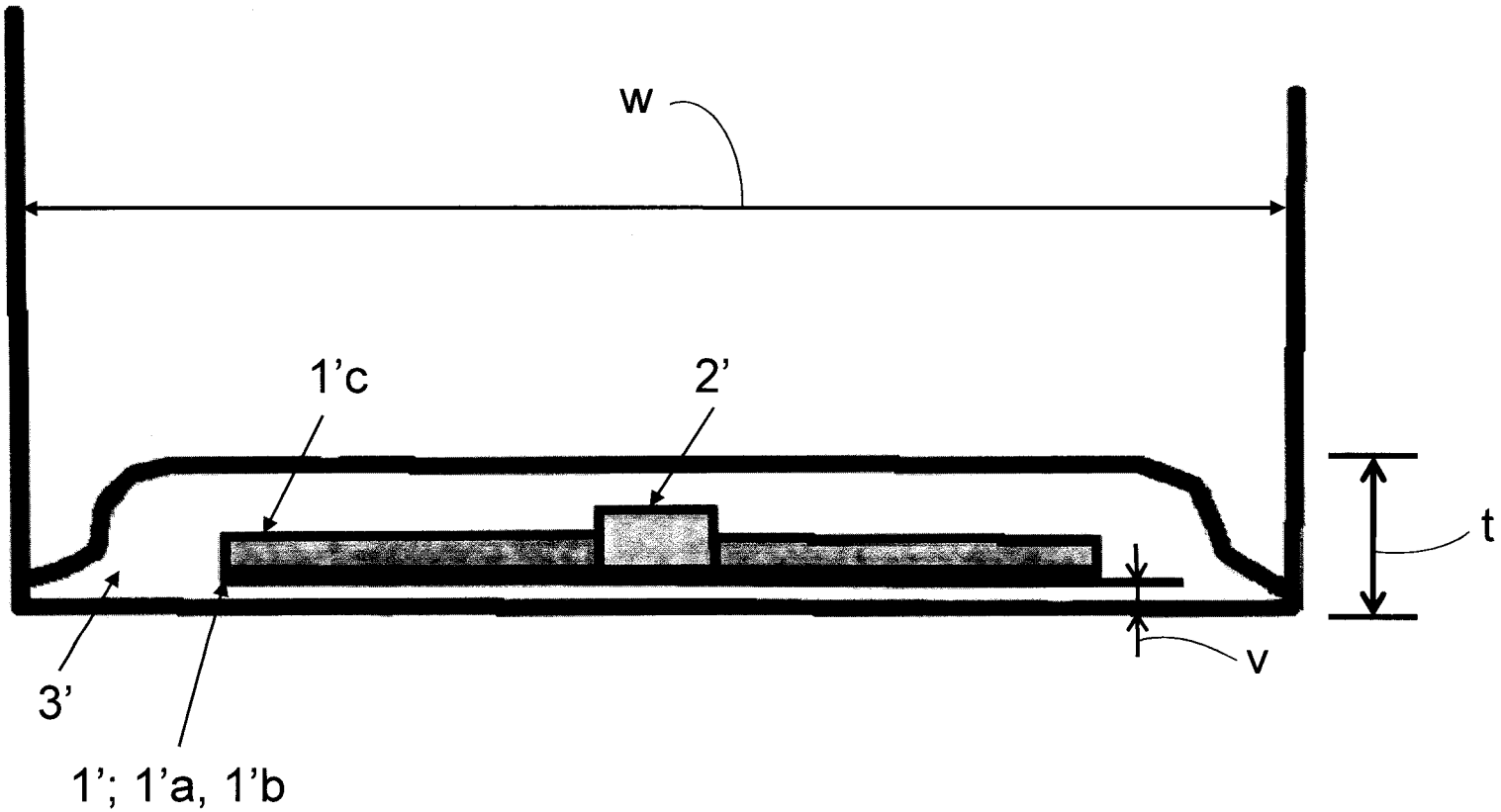
FIG. 3 presents a LED stripe that may be used in the present invention.

FIG. 1 presents an implementation of the present invention utilizing a light or LED 'stripe', i.e. a longitudinal conducting element provided with LEDs, as defined e.g. in WO 98/23896 and further shown in FIG. 3, to control queuing of people.

In the embodiment of FIG. 1 there are three service points Desk 1 to Desk 3. In front of each desk there is a longitudinal LED stripe 101 to 103 that is typically 5 to 10 m long arranged as a stripe line in the direction of each queue.

The stripes 101 to 103 can be located either on or in the floor, on the ceiling or wall mounted or in existing queuing post and tape type systems where the tape was replaced by the stripe.

The service point may be a service desk, security control point, passport control point or other service point for services for different kind of applications. The applications may include:

Queuing of people awaiting service at service desks
Passport control queue control.
Security check areas
Check out tills at supermarkets and other retail establishments
Doctors waiting areas
Pharmacies
Banks
Car park payment booths
Toll booths The system employs stripes consisting of red and/or green LEDs, which are remotely or automatically controlled with a control computer 104 connected to each desk and stripe. Other colours of LED are possible.

The stripe is based on printed circuit board techniques, according to which it is possible to achieve a conducting stripe, that operates in an on/off mode e.g. with alternatively varying colours, and when the stripe includes several longitudinal conductive films it may operated so that it provides a dynamical "moving" light effect which means that the stripes may include dynamic sequencing of the LEDs, that moves along the queuing direction, i.e. toward the desk. Also this moving effect can be implemented with different colours.

By setting up e.g. a floor mounted pattern, such as shown in FIG. 1 the system will enable controlling of people in and entering queues.

The sequences are set up to guide people, for example in FIG. 1 green cross bar 105 would mean you can enter the queue and red cross bars 106, 107 would mean you cannot enter the queue. Red queue line 102 would mean no-one is allowed in the line and green queue lines 101, 103 would mean that people can queue there.

The green queue stripes could be flashing in sequence to direct you to move forward and lit continuously if no movement is needed.

Further light or LED stripes could be added if needed, such as a cross bar in front of the desk to allow people to move forward to the desk or not, or multiple cross bars which would control individual queuers.

As an example the following operation might be programmed into the system:

If the queue is open, and people can join the queue then the green stripe would be on and static and the green stripe bar would be on and static.

If the person at the desk finishes the interaction and leaves, the green stripe could briefly start dynamic sequencing indicating that members in the queue can move forwards.

If the desk is going to close, the cross bar would be changed to red (therefore not allowing people to enter the queue) and the stripe would remain green until the queue had been exhausted and then would turn red.

If the desk was opening, the stripe and cross bar could briefly flash green and then go solid green.

Additionally further stripe(s) could be added in dynamic set up to guide you to the correct queue. So where a number of queues were in place, anyone entering the area would be guided to the shortest or empty queuing place by moving sequences of LEDs within the stripe.

By this method the system can enable direction of people to the required queues, and would enable efficient management of people entering the queues and already in the queues.

The queue control system can be controlled either by a queue specific controlling device, such as a program stored on an EPROM, which would control just the components related to a single queue or each component in the whole system could be centrally controlled by a controlling device such as an EPROM or computer based software program. By this manner the state of the stripes and/or other devices would be controlled so that the system performs as required to guide people efficiently.

Connection between the stripes and the controller could be hard wired or by wireless technology.

Additionally the a further indication for queue availability could be attached to the system, either as a high level light which is on when the queue is open or off when queue is closed or closing.

Additionally a display or number of displays could be incorporated into the system which would give text, symbol or audible signs informing people what to do, open or closed or closing status of the queue etc. This display could also be used for advertising or public notices if so required.

In addition, the system could work completely automatically when attached to sensors or sensing equipment which can identify the number of people in a queue. Examples of these types of queue sensors are e.g. a sensor product for electric field sensing, as described e.g. in US2008238433A. The sensor includes a substrate, electrically conductive areas on the surface of the substrate, an output, and at least one conductor between the at least one electrically conductive area and the output. This sensor product can be arranged as a stripe 108 to 110 along each queue and can be used for identifying the presence or movement of persons in the queue. The sensor product can be hidden as a sensor mat into/onto/under/behind floors, walls or roofs. It is also possible to use cameras where the video is processed to show how many people are in a queue, or movement detectors, or trolley or basket mounted tags which are detected by sensors in the queue locations or proximity detectors, or RFID detectors. Sensors could also be directly integrated within the stripe arrangement.

The system could be operated by push buttons 111 to 113 located at the desks or linked to a number assignment system and used by the clerks or other persons working at the desks.

FIG. 3 shows a led stripe according to WO 98/23896 a led stripe, i.e. conducting element consists at least of an elongated and essentially flat electricity conductive conductor part 1; 1', such as a band or a stripe in which several electric components 2; 2', such as leds, resistors and/or the like bringing out the lighting operation according to the use of the conducting element, are being attached to one after another in the longitudinal direction, and of a casing part 3. The conducting element is being manufactured by arranging the conductor part and the components existing therewith 1; 1', 2; 2' when viewed in a cross section totally surrounded by a casing material 3' forming the said casing part 3, by exploiting a continuous manufacturing process, such as extrusion or like. FIG. 3 illustrates casing part 3 having width W, thickness t, and thickness v under the conductor part 1. The electric components 2' of a conducting element, that enables preferably dynamic use as well, are being attached preferably by means of surface mounting technics to an electric conductor layer 1'*b*, such as to a copper coating or like of a basic material 1'*a*, that is made of plastics, such as polyamide, polyester, polyethylene napthalate or like, of the conductor part 1', that is based on printed circuit board techniques, whereby the electric conductor layer 1'*b* continues essentially uninterruptedly over the whole length of the conducting element, whereafter the entirety being brought out is being surrounded by a casing material 3', that is based on plastics such as pvc, polyurethane, olefin and/or like. The whole structure is fully water-proof.

It is obvious to the person skilled in the art that different embodiments of the invention are not limited to the example described above, but that they may be varied within the scope of the enclosed claims. A longer transversal cross bar 114 having a length that corresponds to the width of all the desks may be arranger in front of all the stripes in order to guide queuing customers especially when there are many, e.g. twenty, desks.

Figure 4:
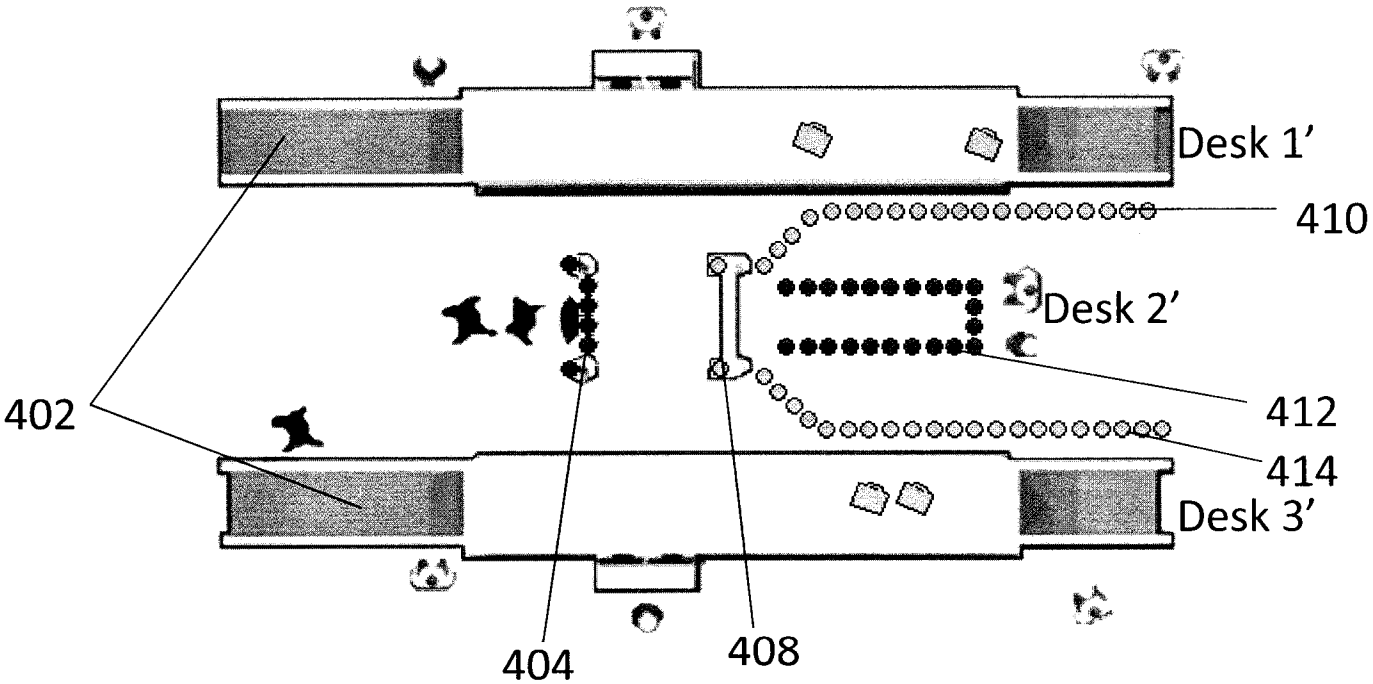
FIG. 4 presents a simplified view of an example implementation of a security control point according to the present invention.

In FIG. 4 a simplified view of an example implementation of a security control point according to the present invention is presented. The security control point may comprise different control points like baggage detector means 402 like x-ray machine for checking baggage, a waiting point for detector means 404 and detector means 408. The detector means can be for example a metal detector. The waiting point 404 can use green light signal to indicate the person that he can proceed to the detector means 408. If detector means is currently in use, a red light can indicate that a person has to wait at the waiting point 404. After the person has walked through the detector means 408, lighting means 410, 414 or 412 can be used to guide the person to a correct point. If for example some metal items are detected, the lighting means 412 may guide the person to a security control person who will conduct a more thorough search for example at Desk 2'. If the detector means 408 detect no items, e.g. metal items, the person may be guided with lighting means 410, 414 to collect his baggage from baggage detector means 402 at Desk 1' or Desk 3'. In the example embodiment of the invention the color of the lighting means 410, 414 is green and color of the lighting means 412 is red. The personnel operating the system can have remote controllers for controlling the status of the system, e.g. for controlling colors of the different indication lights.

Further embodiments of the invention may include:

The queue control system could also be extended to show people out of the area, once they have finished their interaction The queue control system could also be connected to automatic doors for allowing people to exit the area after their interaction has been completed The lighting stripe which is used to guide people to the correct queue could also be multi-colour, which would allow for one person being guided to one queue and another person being guided to another queue simply, and even at the same time. For example, when queuing for a security check an operator can control the stripe to show blue light sequence, and then inform the person to follow that the blue sequence up to the correct queue. A further person might be requested to follow the yellow sequence.

The queue control system could also be connected to a public address system to generate audible messages to reinforce the guidance information.

The queue control system could also be connected to a theft system, so that if the theft system detects a tagged product which sets off an alarm, then this would cause a red stripe to indicate that the person should stop and wait for assistance.

The queue control system can further be fully monitored to indicate if there is a fault, or if light levels are reduced to certain performance levels The queue control system could also be linked to an assistance button, and staff could be guided to the position where assistance is needed.

Although exemplary embodiments of the present invention have been described with reference to the attached drawings, the present invention is not limited to these embodiments, and it should be appreciated to those skilled in the art that a variety of modifications and changes can be made without departing from the spirit and scope of the present invention.

The invention claimed is:

1. A queue control system for guiding persons waiting in one or more queues for service by a plurality of service points, the system comprising:

computer control means for controlling the system, stripe-shaped lighting means arranged for each service point provided with point light sources, and being coupled to a circuit board, the circuit board being adapted to provide variable lighting operations, wherein each of the stripe-shaped lighting means being arranged in a direction of the queues, wherein the computer control means is adapted to variably control the lighting of the striped-shaped lighting means in order to guide the persons in the queues and/or entering and/or leaving the queues, and the system is adapted to light the stripe-shaped lighting means for a specific one or more of the queues with a first color to indicate that the queues may not be used, and to light the stripe-shaped lighting means for a specific one or more of the queues with a second color to indicate that the queue may be used.

2. The queue control system according to claim 1, wherein the lighting means is a LED stripe including an elongated and essentially flat electricity conductive conductor part, in which several electric components for bringing out the lighting operations are connected to one after another in a longitudinal direction of a casing part of the stripe-shaped lighting means leading to a corresponding one of the service points.

3. The queue control system according to claim 2, wherein each of the stripe-shaped lighting means is provided with light sources with different colors.

4. The queue control system according to claim 1, wherein each of the stripe-shaped lighting means is located either on or in a floor, on a ceiling, and/or on a wall.

5. The queue control system according to claim 4, wherein each of the stripe-shaped lighting means is provided with light sources with different colors.

6. The queue control system according to claim 1, wherein each of the stripe-shaped lighting means is operable in at least two different lighting schemes.

7. The queue control system according to claim 6, wherein each of the stripe-shaped lighting means is operable in an on/off mode.

8. The queue control system according to claim 6, wherein each of the stripe-shaped lighting means is operable in order to provide a dynamical "moving" light effect moving along a direction of the length of the stripe-shaped lighting means, and leading toward a corresponding service point.

9. The queue control system according to claim 1, wherein an entry end of each of the stripe-shaped lighting means is provided with cross-bars perpendicular to a direction of a corresponding stripe-shaped lighting means, each of the cross-bars functioning alternatively as:

a stop line in front of a specific one of the service points to not allow the persons to move to along the length of the stripe-shaped lighting means of the specific one of service points, or as an enter line in front of the specific one of the service points to allow one of the persons to enter and to move along the length of the stripe-shaped lighting means leading to the specific one of the service points.

10. The queue control system according to claim 1, wherein the first color is a red color and the second color is a green color.

11. The queue control system according to claim 10, wherein system is adapted to enable the green color to be flashing in sequence in order to guide the persons forward and to move along the length of the stripe-shaped lighting means, and to control the green color to be lit continuously if no movement is needed.

12. The queue control system according to claim 11, wherein each of the indicators includes a substrate, and electrically conductive areas on the surface of the substrate, an output, and at least one conductor between the at least one electrically conductive area and the output.

13. The queue control system according to claim 1, wherein the system is adapted to automatically identify a number of the persons in each of the queues, and adjacent to each of the queues, wherein indicators or sensors are arranged along a length of each of the stripe-shaped lighting means corresponding to each of the queues, or adjacent to each of the queues, and are adapted to identify a presence or a movement of the persons in each of the queues.

14. The queue control system according to claim 1, wherein the system is operable by a control device located at each of the service points, and/or linked to a number assignment system, and used by the person working at each of the service points.

15. The queue control system according to claim 1, wherein each of the stripe-shaped lighting means is multi-colored, in order to guide one of the persons to one of the queues, and to concurrently guide another of the persons to another of the queues.

16. The queue control system according to claim 1, wherein the queue control system is controlled either by a queue specific controlling device, such as a program stored on an EPROM, the queue specific controlling device being adapted to control components related to a single one of the queues, or to centrally control each of the components in the system.

17. The queue control system according to claim 1, further comprising:

at least one transversal cross bar having a length that is at least equal to a width of all the service points arranged side-by-side and extending in front of and perpendicular to each of the stripe-shaped lighting means corresponding to each of the service points.

18. The queue control system according to claim 1, further comprising:

detector means for checking one or more of the persons in each of the queues, and based on a response of the detector means, the lighting means of a corresponding queue is controlled to guide the persons to a different one of the service points.

19. The queue control system according to claim 1, wherein the system is used at a security check service point.

* * * * *